US008864553B2

(12) United States Patent
Vigano

(10) Patent No.: US 8,864,553 B2
(45) Date of Patent: Oct. 21, 2014

(54) FLUID JET CUTTING SYSTEM

(75) Inventor: Luca Vigano, Triuggio (IT)

(73) Assignee: MC Machinery Systems, Inc., Wood Dale, IL (US)

( * ) Notice: Subject to any disclaimer, the term of this patent is extended or adjusted under 35 U.S.C. 154(b) by 231 days.

(21) Appl. No.: 13/604,957

(22) Filed: Sep. 6, 2012

(65) Prior Publication Data

US 2013/0237132 A1 Sep. 12, 2013

Related U.S. Application Data

(60) Provisional application No. 61/547,937, filed on Oct. 17, 2011.

(51) Int. Cl.

| | |
|---|---|
| ***B24C 5/04*** | (2006.01) |
| ***B26D 5/00*** | (2006.01) |
| ***B26F 1/38*** | (2006.01) |
| ***B26F 3/00*** | (2006.01) |

(52) U.S. Cl.

CPC . *B24C 5/04* (2013.01); *B26D 5/005* (2013.01); *B26D 7/26228* (2013.01); *B26F 1/3813* (2013.01); *B26F 3/004* (2013.01)

USPC ..... 451/102; 451/91; 451/99; 451/38

(58) Field of Classification Search

CPC ..... B24C 5/04; B24C 5/02; B24C 7/0084; B24C 7/0046; B24C 1/045; B26D 5/005; B26D 7/2628; B26F 1/3813

USPC ..... 451/2, 5, 8, 9, 38–40, 75, 86, 91, 99, 451/102; 83/34, 53, 177, 589, 699.51, 829, 83/548; 175/6; 408/180, 187

See application file for complete search history.

(56) References Cited

U.S. PATENT DOCUMENTS

| | | | | |
|---|---|---|---|---|
| 2,462,573 | A * | 2/1949 | Turrettni | 408/16 |
| 3,566,543 | A * | 3/1971 | James | 451/2 |
| 3,877,334 | A | 4/1975 | Gerber | |
| 4,545,271 | A * | 10/1985 | Romi | 82/149 |
| 4,967,053 | A | 10/1990 | Aharon | |
| 5,367,929 | A | 11/1994 | Burch et al. | |
| 5,472,367 | A | 12/1995 | Slocum et al. | |
| 5,508,596 | A | 4/1996 | Olsen | |
| 5,892,345 | A | 4/1999 | Olsen | |
| 6,280,292 | B1 * | 8/2001 | Sato et al. | 451/9 |
| 6,283,832 | B1 * | 9/2001 | Shepherd | 451/40 |
| 6,766,216 | B2 | 7/2004 | Erichsen et al. | |

(Continued)

FOREIGN PATENT DOCUMENTS

| | | |
|---|---|---|
| DE | 20 2005 002 873 | 5/2005 |
| DE | 20 2007 012 572 | 12/2007 |

*Primary Examiner* — George Nguyen

(74) *Attorney, Agent, or Firm* — Wood, Phillips, Katz, Clark & Mortimer

(57) ABSTRACT

A taper head control assembly is provided for a fluid jet cutting system. A base is movably mounted relative to a cutting table. A tilt body carries a fluid jet cutting apparatus and includes a rack. A tilt housing supports the tilt body and includes a pinion engaging the rack for selectively tilting the fluid jet cutting apparatus. A rotational axis housing is mounted to the base and a collar is rotatably mounted relative to the rotational axis housing. The collar carries the tilt axis housing to selectively rotate the water jet cutting apparatus relative to the base.

22 Claims, 19 Drawing Sheets

(56) References Cited

U.S. PATENT DOCUMENTS

| | | | | |
|---|---|---|---|---|
| 6,922,605 | B1 | 7/2005 | Olsen | |
| 6,932,285 | B1 | 8/2005 | Zemg | |
| 6,996,452 | B2 | 2/2006 | Erichsen et al. | |
| 7,035,708 | B1 | 4/2006 | Olsen | |
| 7,074,112 | B2 * | 7/2006 | Olsen | 451/11 |
| 7,331,842 | B2 * | 2/2008 | Sciulli et al. | 451/2 |
| 7,464,630 | B2 * | 12/2008 | Knaupp et al. | 83/177 |
| 7,703,363 | B2 | 4/2010 | Knaupp et al. | |
| 8,540,552 | B2 * | 9/2013 | Reukers | 451/91 |
| 2002/0066345 | A1 * | 6/2002 | Shepherd et al. | 83/53 |
| 2004/0048548 | A1 * | 3/2004 | Shepherd | 451/2 |
| 2011/0147347 | A1 * | 6/2011 | Maurer | 219/121.18 |

* cited by examiner

FLUID JET CUTTING SYSTEM

CROSS-REFERENCE TO RELATED APPLICATIONS

This application claims priority of provisional application No. 61/547,937 filed Oct. 17, 2011.

FEDERALLY SPONSORED RESEARCH OR DEVELOPMENT

Not Applicable.

MICROFICHE/COPYRIGHT REFERENCE

Not Applicable.

FIELD OF THE INVENTION

This application relates to high pressure fluid jet cutting systems and, more particularly, to a taper head control assembly.

BACKGROUND

Numerous different products are used to provide precision cutting of various materials. These products can range from a simple cutting saw to a numerically controlled machine tool. One such system is a so-called water jet cutting system which uses a high velocity jet of liquid mixed with an abrasive to cut a material into a particular shape. The shape is defined by a cutting path to be followed by a cutting jet nozzle. Operating commands to control nozzle position define straight lines and arcs to be cut in a particular sequence using parameters stored in a memory. For each line or arc, the parameters include, among others, a tilt angle to control taper. Taper control is extremely important to the production of high-precision parts with water jet technology. A number of factors influence the amount of taper in a cut, including cut speed, the thickness and the hardness of the material being cut. Greatly reducing cut speed is one way to easily reduce or eliminate taper. However, this comes at a cost in productivity. Various known systems analyze cuts and provide taper control without the need for reducing speed by angling the nozzle while maintaining stream velocity. The result is a final part that is produced faster and with straighter walls, regardless of the thickness or composition of the material being cut.

Known taper control systems use a fixed mechanical tilt or utilize a complex mechanical arrangement to control a tilt angle and maintain the desired angle while cutting corners.

The present application is directed to improvements in taper control systems.

SUMMARY

A taper head control assembly is disclosed for a fluid jet cutting system.

Broadly, there is disclosed a taper head control assembly for a cutting system. A base is movably mounted relative to a cutting table. A tilt body carries a cutting apparatus and includes a rack. A tilt housing supports the tilt body and includes a pinion engaging the rack for selectively tilting the cutting apparatus. A rotational axis housing is mounted to the base and a collar is rotatably mounted relative to the rotational axis housing. The collar carries the tilt axis housing to selectively rotate the cutting apparatus relative to the base.

It is a feature that the tilt body comprises a groove and the tilt housing comprises a guide. The guide is slideably received in the groove to support the tilt body in the tilt housing.

It is another feature that the guide comprises a curved projection and the groove comprises a curved groove.

It is still another feature to provide a motor mounted to the tilt housing for driving the pinion.

It is a further feature that the tilt housing comprises a tubular frame telescopically receiving the tilt body. The tubular frame includes a guide having a curved projection and the tilt body includes a curved groove receiving the curved projection.

It is still a further feature that the tilt body includes rollers at ends of the groove and the rollers ride on the curved projection.

It is another feature that the rack comprises a curved rack.

It is still a further feature to provide a motor fixedly mounted relative to the base and a belt driven by the motor and operatively received on the collar to selectively rotate the cutting apparatus relative to the base.

It is yet another feature that the tilt housing and the tilt body are adapted to maintain a fixed focal point of the cutting apparatus at any tilt angle.

It is still another feature that the tilt housing and the tilt body are adapted to tilt the cutting apparatus at any angle between 0° and about 6°.

It is still a further feature that the tilt body comprises an elongate block having a cylindrical through opening receiving a nozzle tube. One end of the nozzle tube supports a nozzle and an opposite end is connected to a source of high pressure fluid. The rack is secured to an upper end of the elongate block.

More particularly, a cutting system uses conventional methodology to control X, Y and Z positions which define straight lines and arcs. A taper head control assembly directs a jet of fluid to reduce the taper effect which is inherent to fluid jet cutting. The system uses a motorized A axis tilt control in conjunction with a rotational C axis. Particularly, the taper head control tilts the control head assembly up to 6° by using a rack and pinion system driven by a brushless motor. The entire taper head control assembly, including the valve, nozzle tube, mixing chamber and focusing tube, is tilted by the motorized A axis tilt control. The taper head control assembly is guided by a curved linear guide. This structure maintains the focal point of the jet, without the need of Z axis compensation.

The taper head control assembly is mounted inside a C axis control assembly including a roller bearing. The taper head control assembly is rotated by a brushless motor through a timing belt. The direction of the jet of fluid is a compound angle created by the tilt of the A axis, up to 6°, and the rotation of the C axis, rotational through 360°. The C axis control assembly is composed of a cross roller bearing and a slip ring needed to power the A axis brushless motor.

Other features and advantages will be apparent from a review of the entire specification, including the appended claims and drawings.

DETAILED DESCRIPTION

Figure 1:
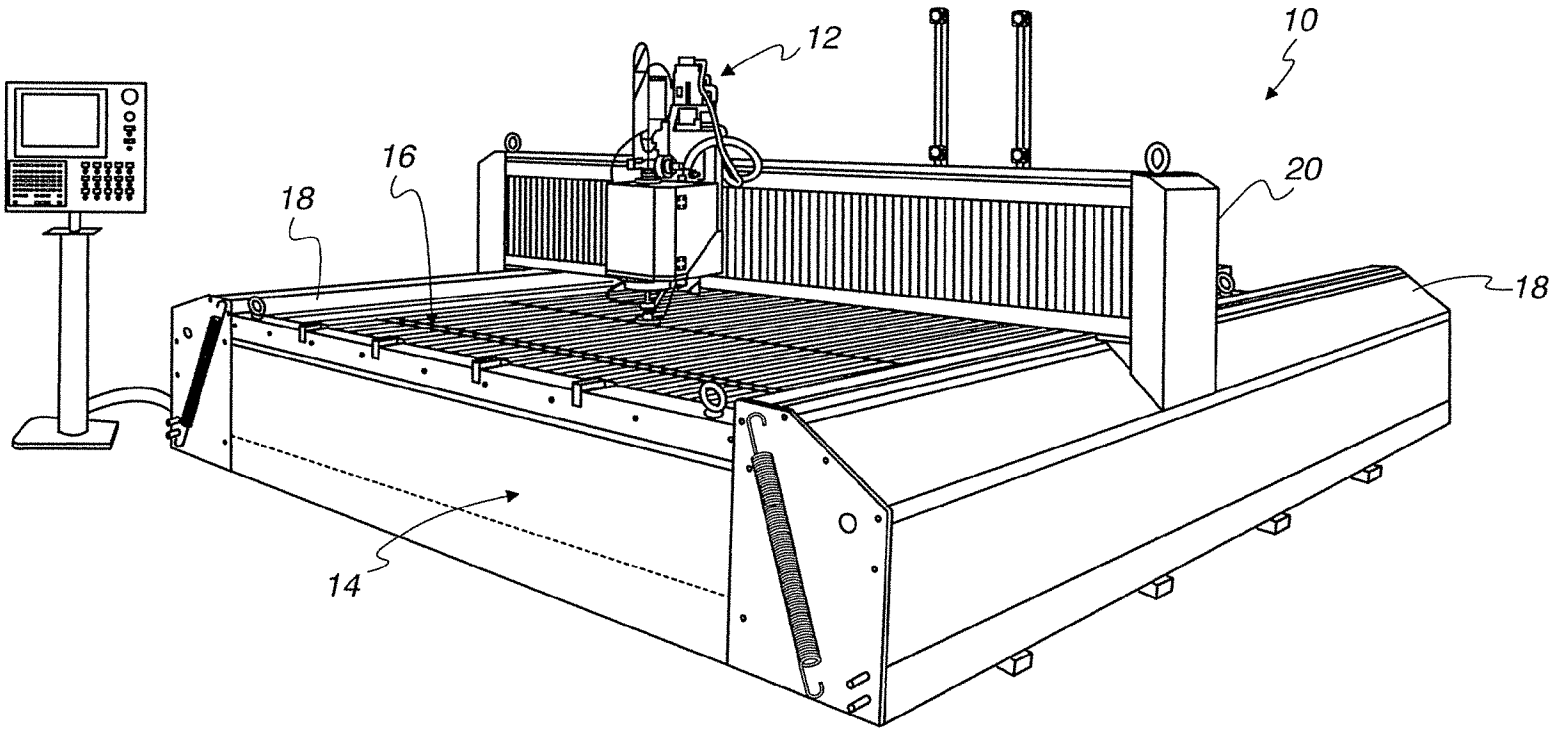
FIG. 1 is a perspective view of a high pressure water jet cutting system including a cutting head assembly.

With reference to FIG. 1, a high pressure water jet cutting system 10 including a cutting head assembly 12 is illustrated. The cutting head assembly 12 combines high pressure water with a garnet abrasive to function as the cutting tool. While the invention is described in connection with use of an abrasive water mixture, the invention can be used to deliver other fluids at high pressure to implement a cutting operation.

The water jet cutting system 10 comprises a cutting table in the form of a tank 14 of conventional construction including a slat and support frame 16. A workpiece to be cut is mountable on the frame 16 in any known manner. The tank 14 includes opposite guide rails 18. The guide rails 18 support a bridge 20 which is controllably movable along the guide rails 18, as is known. The cutting head assembly 12 is movable across the bridge 20 and is movable vertically relative to the bridge 20. The movement of the bridge 20 relative to the tank 14, and the cutting head assembly 12 relative to the bridge 20 are implemented to control X, Y and Z axis movement in a conventional manner.

As will be apparent, the present invention is directed particularly to the cutting head assembly 12. The tank 14 and components for controlling movement of the cutting head assembly 12 may be of various different designs capable of controlling the X, Y and Z axis movement.

Figure 2:
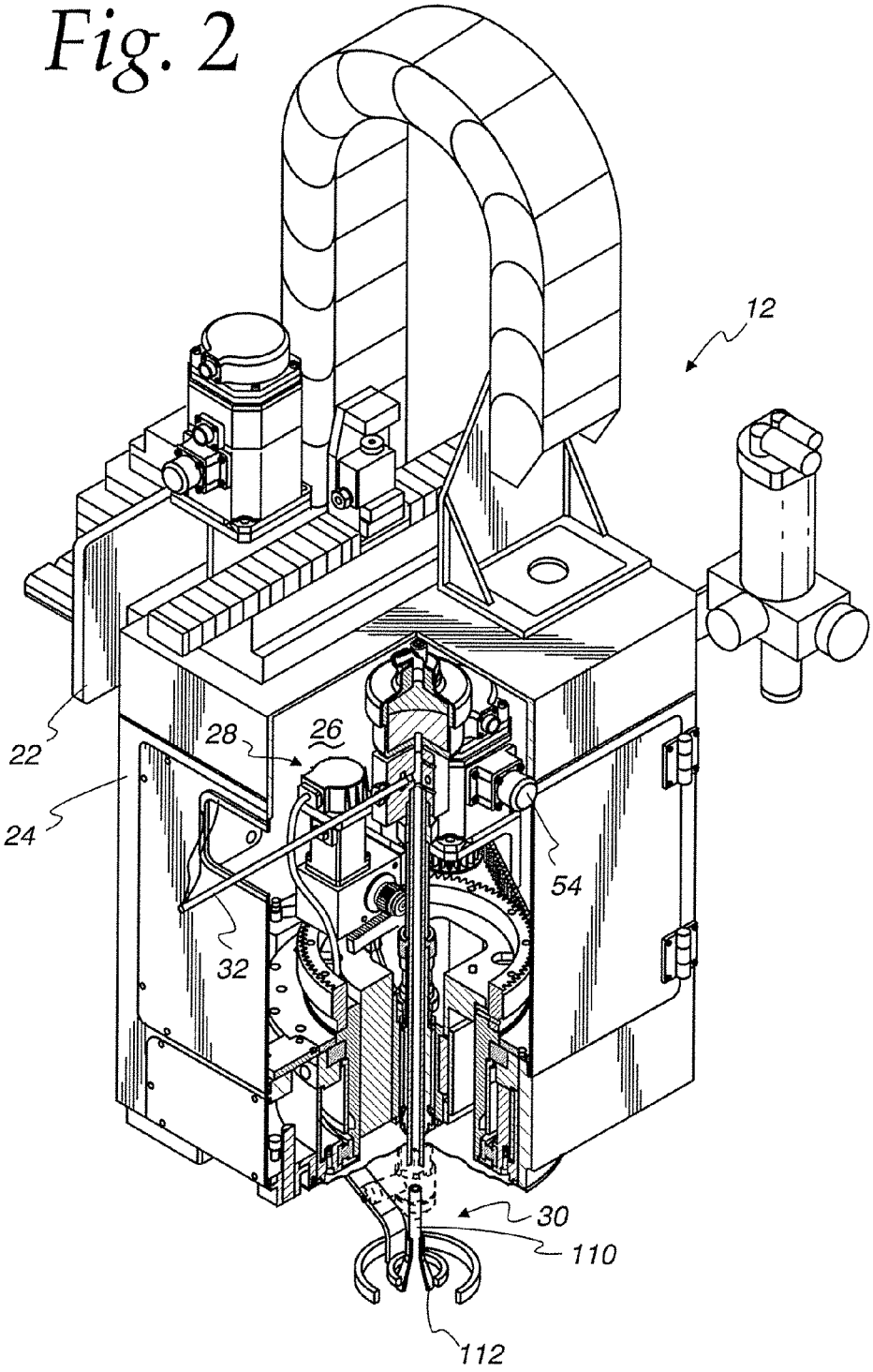
FIG. 2 is a perspective, partially section, view of the cutting head assembly of FIG. 1.

With reference to FIG. 2, the cutting head assembly 12 is illustrated in greater detail. The cutting head assembly 12 includes a base 22 movably mountable in a known manner to the bridge 20, see FIG. 1. A parallelepiped housing 24 is fixedly mounted to the base 22 and is thus movable therewith. The housing 24 defines an enclosed space 26 housing a taper head control assembly 28 in accordance with the invention. The taper head control assembly 28 includes a cutting apparatus in the form of a water jet assembly 30 operatively connected to a source of high pressure fluid represented by an inlet line 32. The taper head control assembly 28 in accordance with the invention is operable to tilt and rotate the water jet assembly 30, as described below, while maintaining a fixed focal point, relative to the base 22. Thus, X, Y and Z axis movement of the water jet assembly 30 are controlled by position of the base 22 and thus the housing 24, while A axis tilt and rotation about a C axis are controlled by the taper head control assembly 28, as described below.

Figure 3:
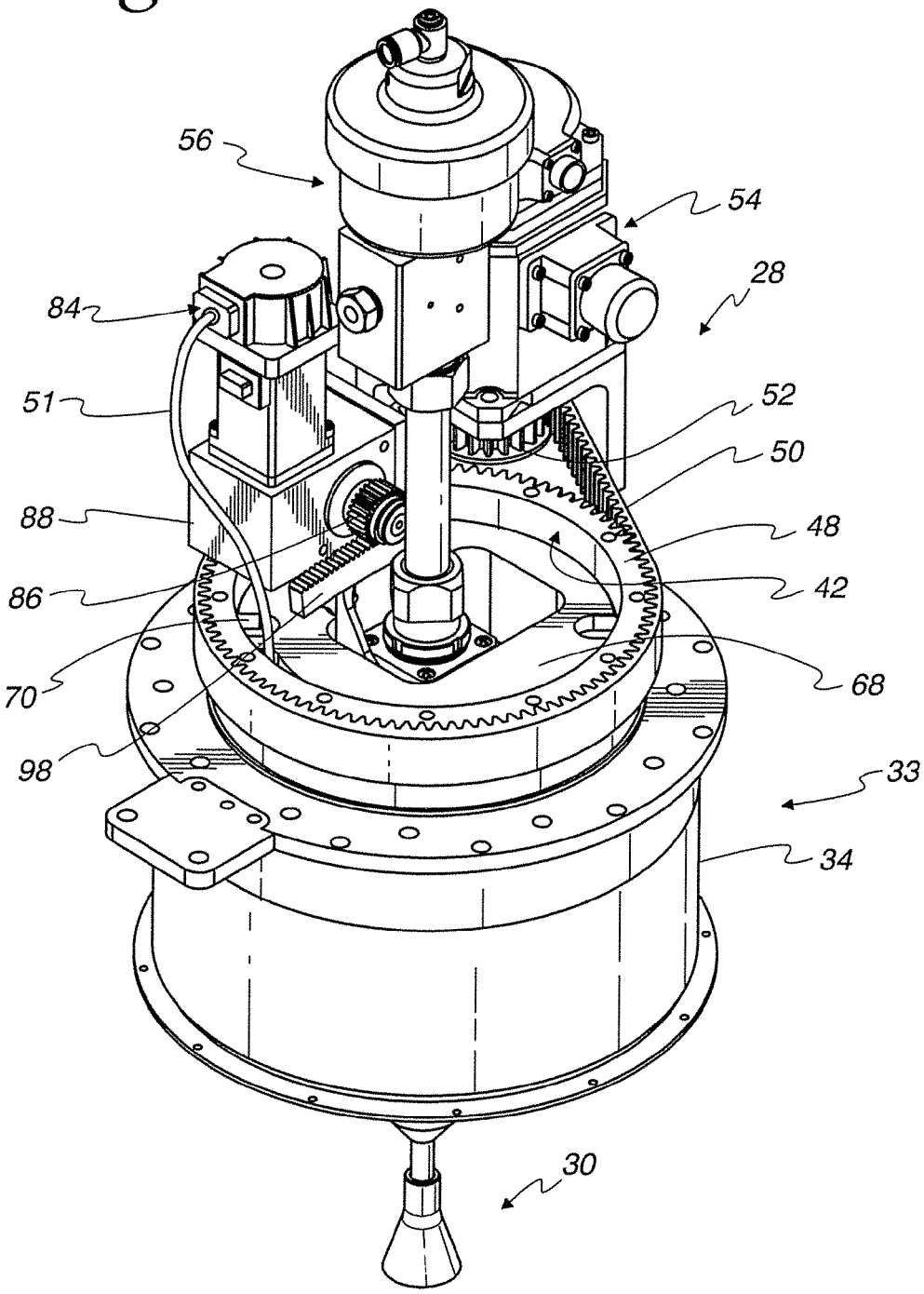
FIG. 3 is a perspective view of a taper head control assembly of the cutting head assembly of FIG. 2.

With reference to FIG. 3, the taper head control assembly 28 includes a C axis control assembly 33 for controlling rotational C axis movement in conjunction with a tilt head control assembly 56 for controlling a tilt angle relative to a vertical A axis.

Figure 4:
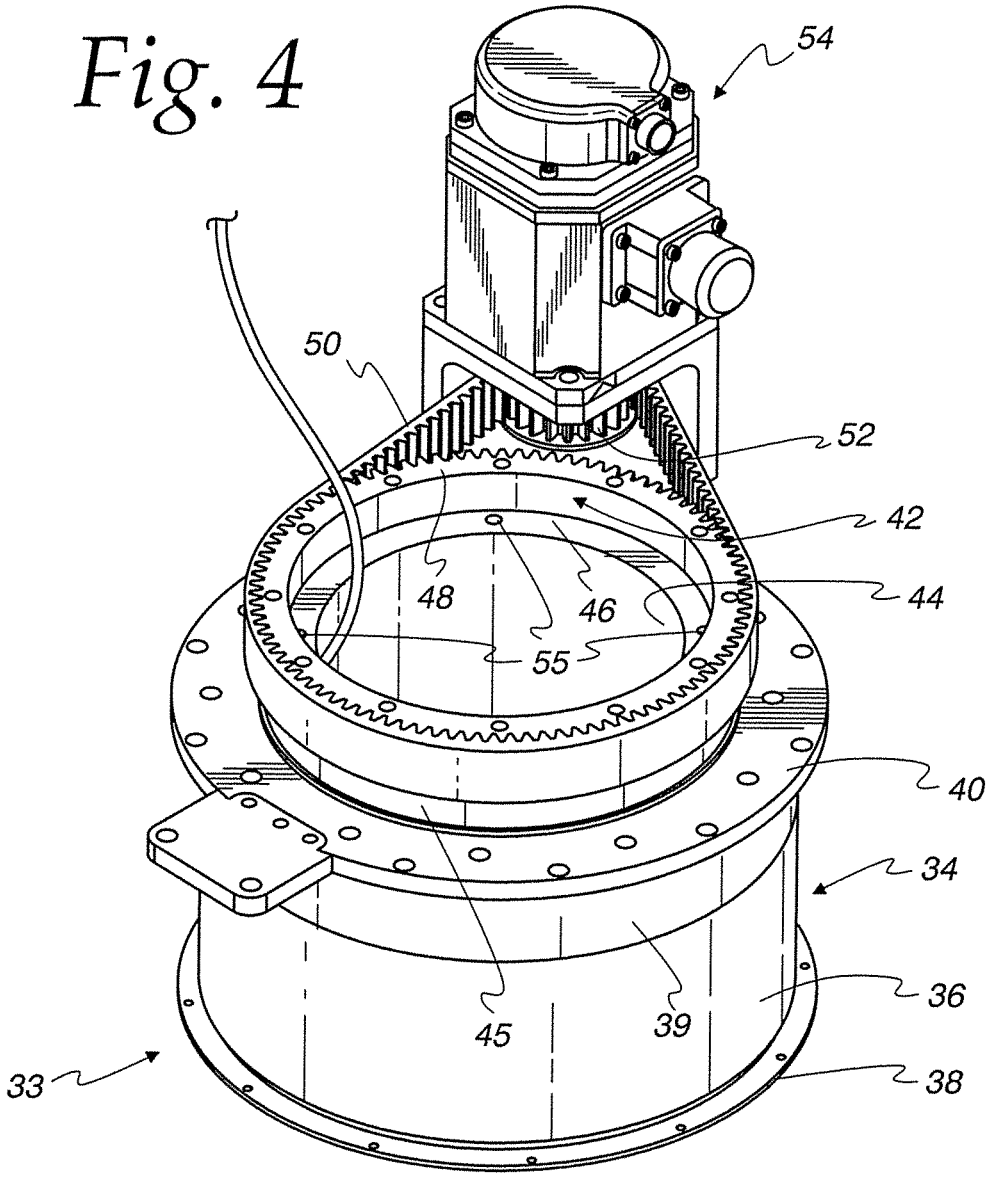
FIG. 4 is a perspective view of the C axis control assembly of the taper head control assembly of FIG. 3.
Figure 4A:
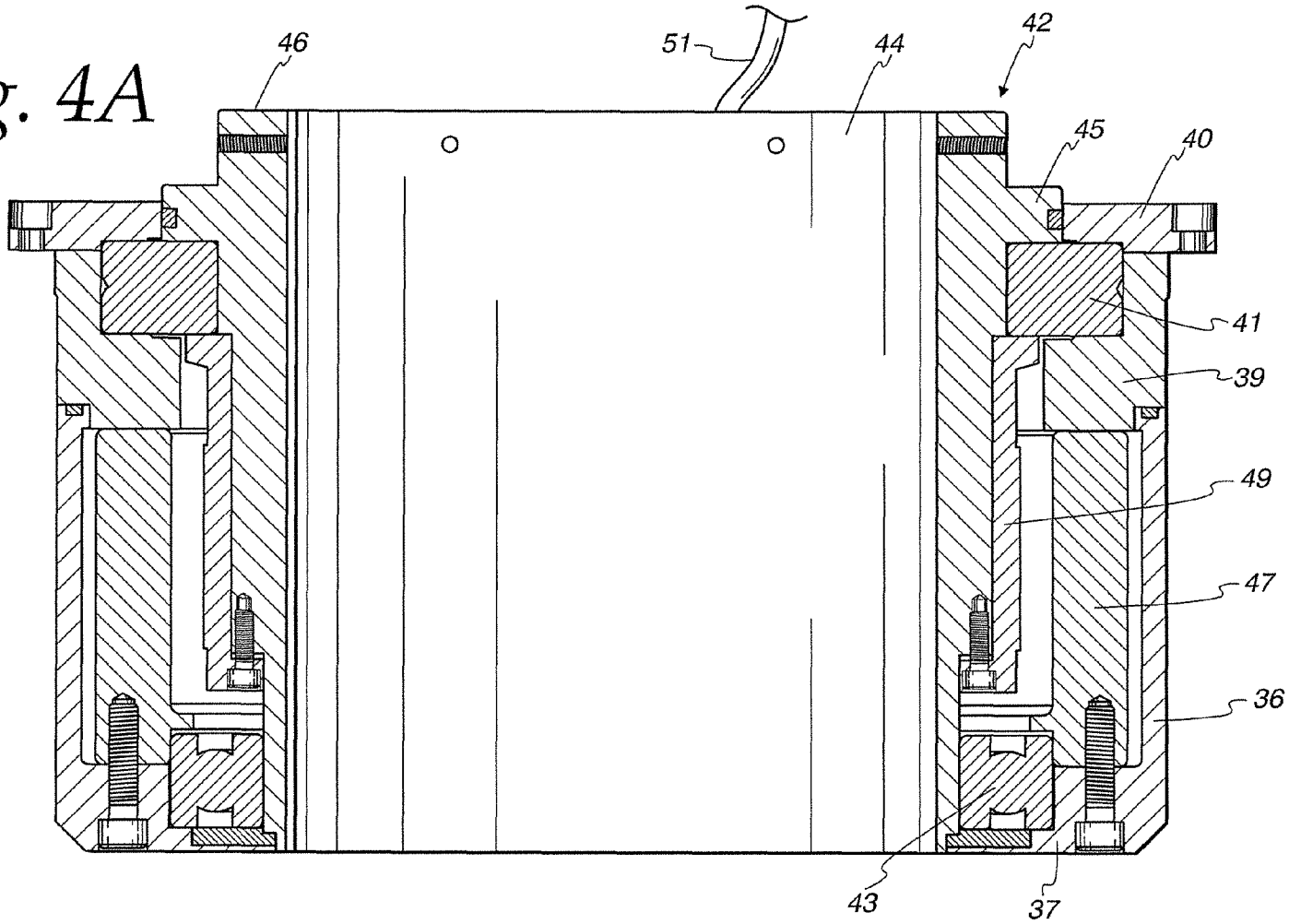
FIG. 4A is a sectional view of the C axis housing of the C axis control assembly of FIG. 4.

The C axis control assembly 33, see also FIGS. 4 and 4A, includes a generally cylindrical housing 34. The housing 34 is also referred to herein as a C axis housing or a rotational axis housing. The C axis housing 34 is fixedly mounted in the enclosure 24 in any known manner, as generally illustrated in FIG. 2. The C axis housing 34 comprises a lower cylindrical wall 36 turned inwardly at a bottom annular wall 37. A lower annular flange 38, see FIG. 4, extends outwardly from the lower cylindrical wall 36 for mounting the housing 34. An upper cylindrical wall 39, that is L-shaped in cross section, is atop the lower cylindrical wall 36. An upper annular flange 40 is mounted atop the upper cylindrical wall 39.

A collar 42 is rotationally mounted in the C axis housing 34 and includes a cylindrical shell 44 having an upper annular edge 46. An outwardly extending shoulder 45 is just below the upper annular edge 46 . . . . A cross roller bearing 41 is captured between the upper cylindrical wall 39, the upper annular flange 40, the shoulder 45 and the shell 44. A radial bearing 43 is secured on the bottom annular wall 37 surrounding a bottom end of the shell 44. A driven gear 48, see FIG. 4, is secured outwardly of an upper end of the shell 44 above the shoulder 45. The driven gear 48 extends upwardly from the upper annular edge 46 and is driven by a timing belt 50 by a drive gear 52. The drive gear 52 is driven by a brushless motor 54. Particularly, the brushless motor 54 can be driven in either direction to selectively rotate the collar 42 relative to the C axis housing 34. The C axis housing 34 supports brushes 47 and slip rings 49. The brushes 47 are secured in the C axis housing 34 inwardly of the lower cylindrical housing 36 between the bottom annular wall 37 and the upper cylindrical housing 39. The slip rings 49 are secured outwardly of the shell 44, as shown. An electrical cord 51 is secured to the slip rings 49 in any known manner and extends through the shell 44 exiting at the upper annular edge 46. The brushes 47, the slip rings 49 and the cord 51 are for powering the tilt head control assembly 56. The upper annular edge 46 includes a plurality of openings 55.

Figure 5:
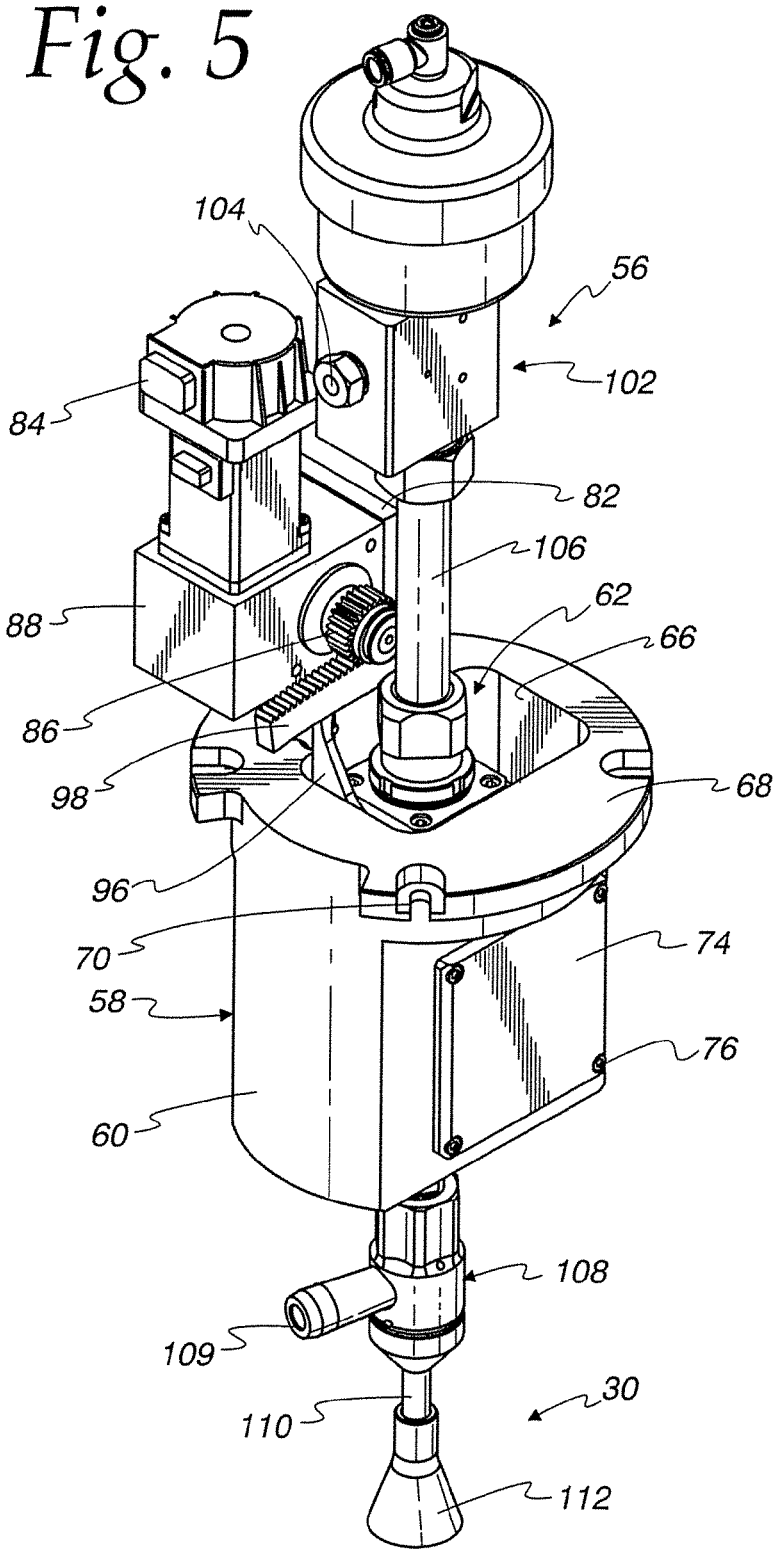
FIG. 5 is a perspective view of the tilt head control assembly of the taper head control assembly of FIG. 3.
Figure 6:
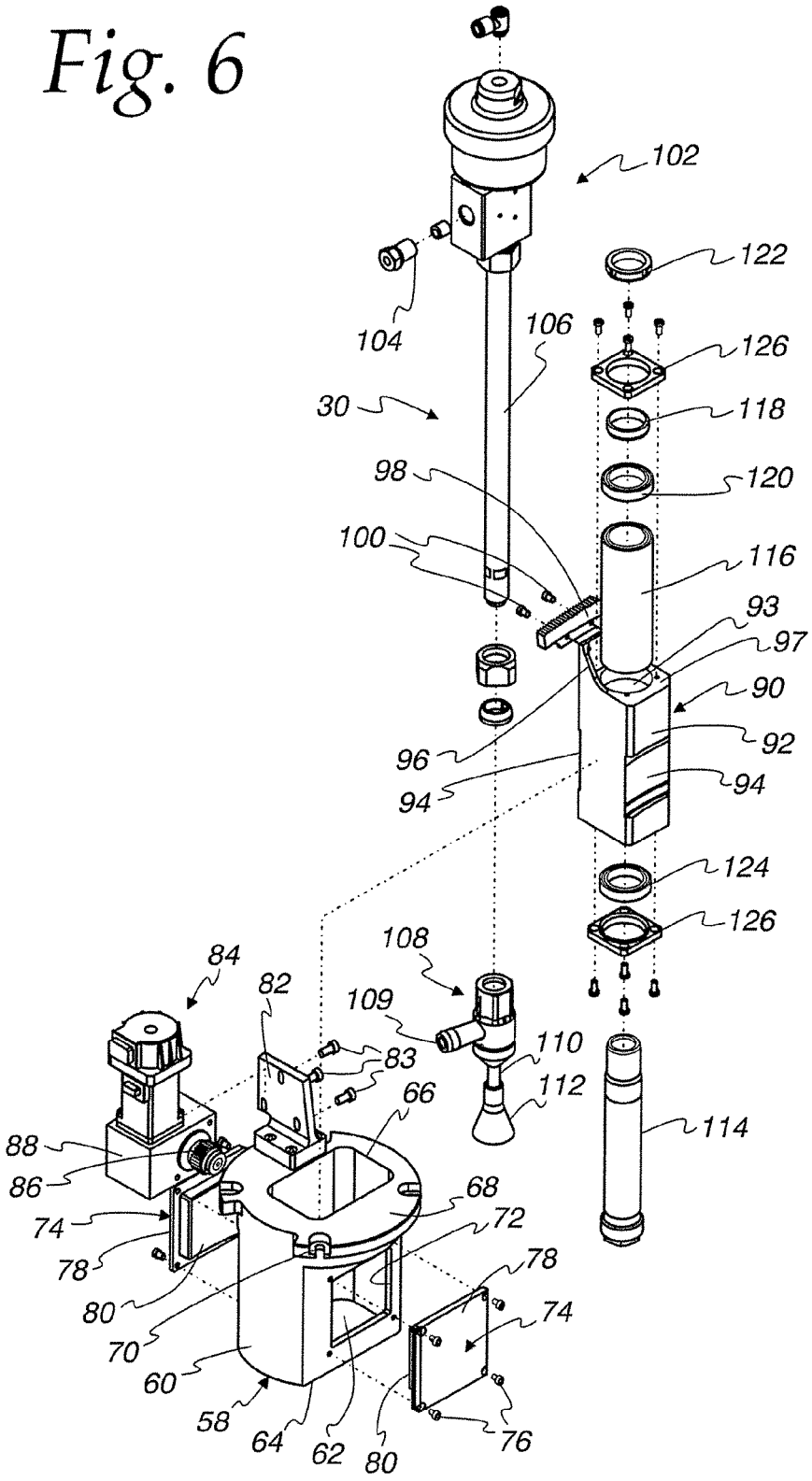
FIG. 6 is an exploded view of the tilt head control assembly of FIG. 5.

Referring to FIGS. 5 and 6, the motorized A-axis tilt head control assembly 56 in accordance with the invention is illustrated. The tilt head control assembly 56 comprises a tilt housing 58. The tilt housing 58 comprises a generally tubular frame 60 defining an elongate interior space 62. The frame 60 is open at a bottom end 64 and an opposite top end 66. An annular flange 68 extends outwardly from the top end 66. The annular flange 68 includes a plurality of slots 70 proximate its outer edge. The tilt housing 58 is of a size to be received in the C axis housing shell 44. The annular flange 68 is of a size corresponding to the shell upper annular edge 46. The tilt housing 58 is secured to the shell 44, as generally illustrated in FIG. 3, via fasteners (not shown) through the slots 70 into the upper annular edge openings 55. As such, the tilt housing 58 is rotational with the collar 42 under control of the brushless motor 54.

The tubular frame 60 includes a pair of rectangular openings 72, one of which is shown in FIG. 6, on opposite sides thereof. A slide 74 is mounted over each opening 72 using fasteners 76. Each slide 74 comprises a plate 78 having a guide in the form of a curved projection 80 extending inwardly to the space 62. Particularly, the two curved projections 80 face one another within the space 62. A bracket 82 is mounted atop a rear side of the annular flange 68. A gear box 88 having an output pinion gear 86 is secured to the bracket 82 using fasteners 83. A brushless motor 84 drives the gears that are in the gear box 88 to in turn drive the pinion 86. The brushless motor 84 is electrically connected to the electrical cord 51.

A tilt body 90 comprises an elongate block 92 having a cylindrical through opening 93. A curved or arcuate groove 94 is provided on both a front side and a rear side of the block 92. The grooves 94 are of a size and shape corresponding to the curved projections 80. In accordance with the invention, the tilt body block 92 is telescopically received in the tilt housing interior space 62 with the curved projections or guides 80 received in the curved grooves 94. As such, the tilt body 90 can move laterally within the space 62 so that the tilt body 90 is effectively "tilted" relative to the tilt housing 58, as described below, owing to the curvature of the projections 80 and grooves 94. The block 92 includes a rear projection 96 extending upwardly from a top end 97. The rear projection 96 supports a curved rack 98 secured by fasteners 100. Incident to the tilt body 90 being positioned in the tilt housing space 62, the pinion 86 engages the rack 98 as shown in FIG. 5. Rotation of the pinion 86 moves the tilt body 90 laterally with curvature of the projections 80 and grooves 94 causing the tilt body 90 to tilt, as discussed above. As such, the motor 84 is operated to control a tilt angle of the tilt body 90 relative to the tilt housing 58.

The water jet assembly 30 comprises an on/off valve 102 having an inlet adaptor 104 for connection to the high pressure water supply line 32, see FIG. 2. The valve 102 is connected to a nozzle tube 106 which is in turn connected to a mixing chamber 108 having a port 109 for connection to a supply of abrasive material. A focusing tube 110, defining a nozzle, is connected to an outlet of the mixing chamber 108 and is surrounded by a splash guard 112, see also FIG. 7.

The nozzle tube 106 is received in the tilt body cylindrical opening 93 to be movable therewith. Particularly, the nozzle tube 106 is surrounded by an internal shaft support 114 which is in turn received in a shim ring 116 within the cylindrical opening 93. A taper 118 and lock rings 120 and 122 secure the nozzle tube 106 relative to the tilt body 90. A contact bearing 124 and plate shim bearings 126 are in turn secured to the tilt body 94 at opposite ends of the cylindrical opening 93.

Figure 7:
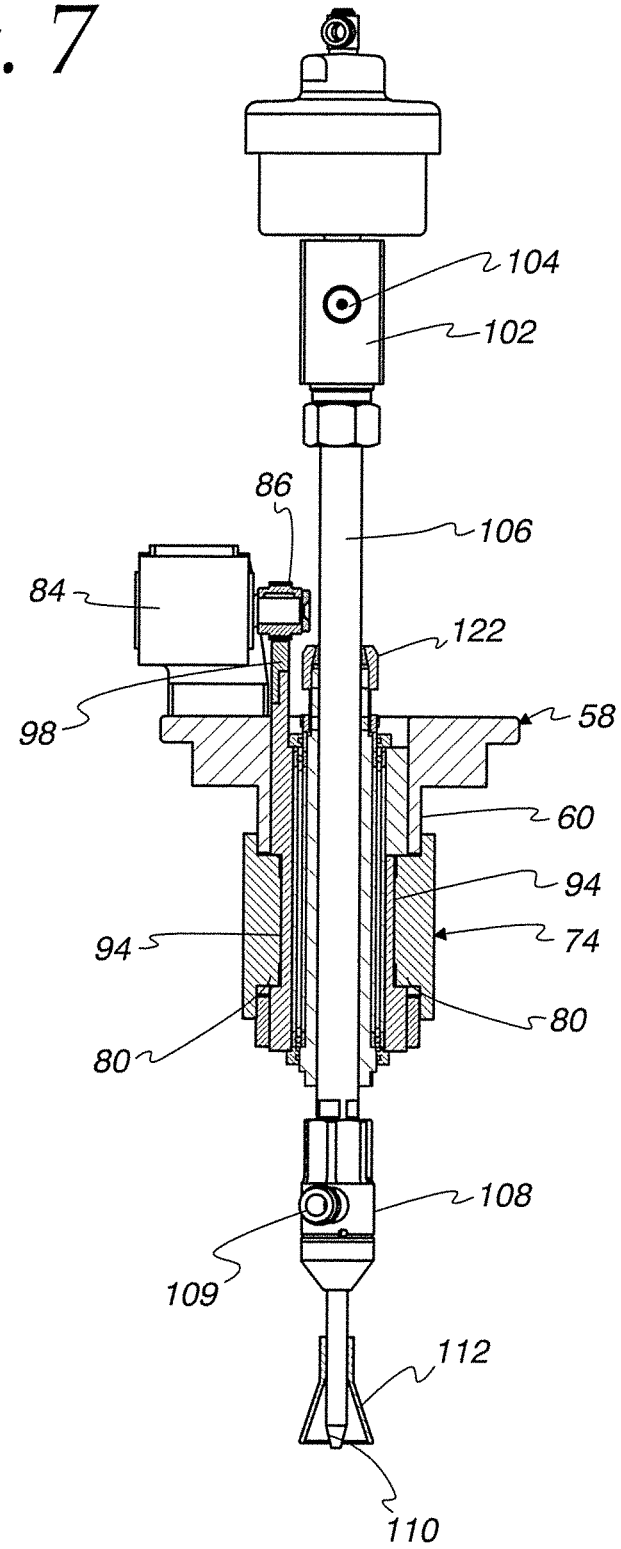
FIG. 7 is a side elevation, partially sectional, view of the tilt head control assembly of FIG. 5.
Figure 8:
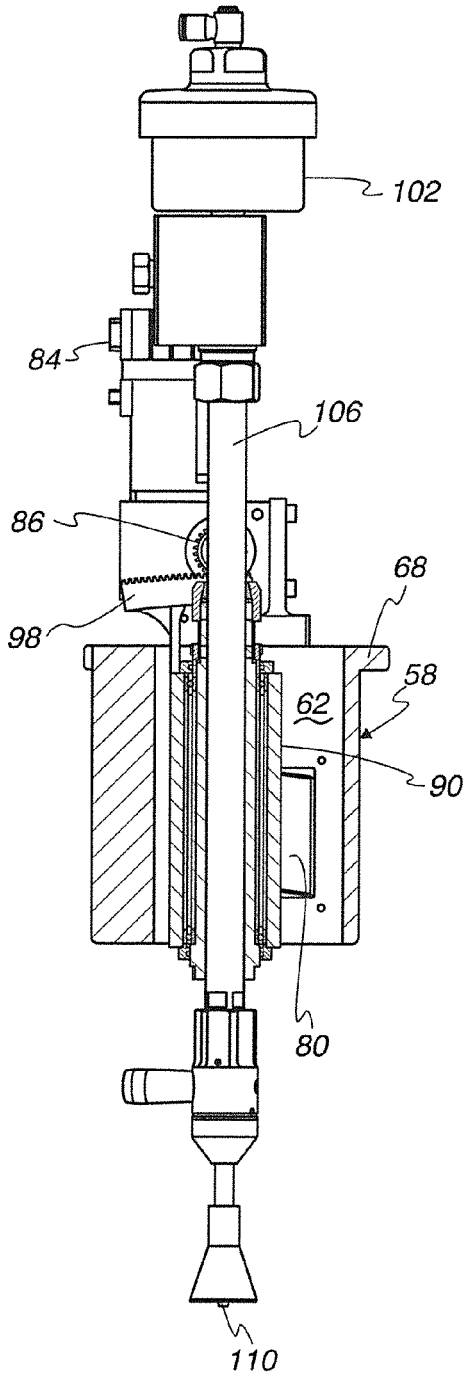
FIG. 8 is a front elevation, partially sectional, view of the tilt head control assembly of FIG. 5 with the nozzle at a 0° tilt angle.
Figure 9:
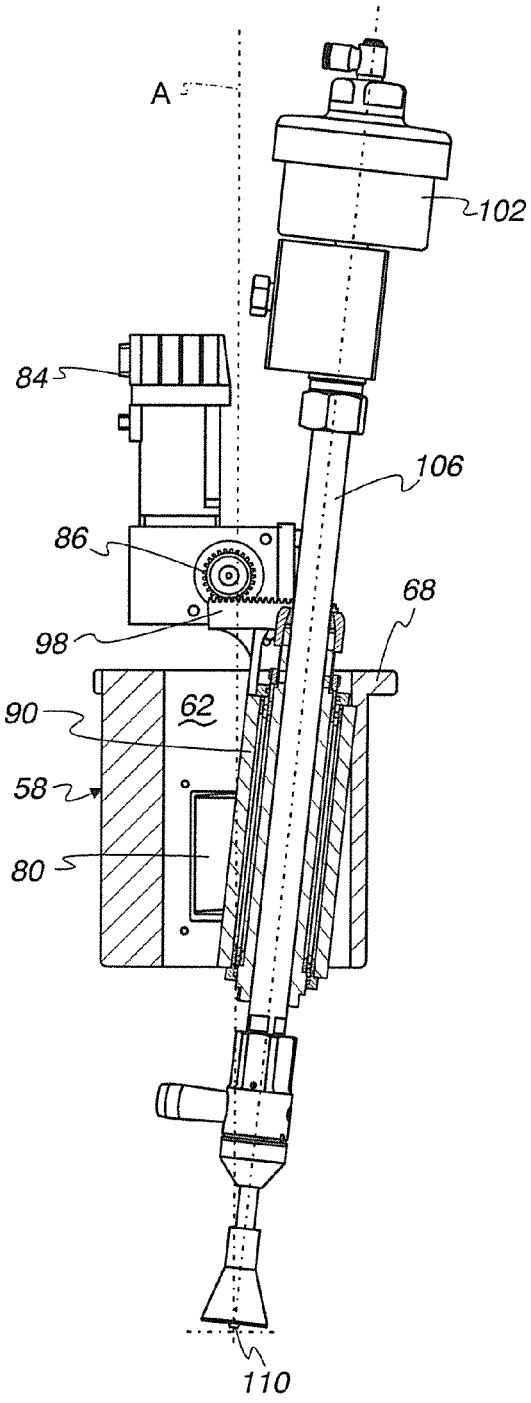
FIG. 9 is a front elevation, partially sectional, view, similar to FIG. 8, of the tilt head control assembly of FIG. 5 with the nozzle at a 6° tilt angle.

Referring to FIGS. 8 and 9, the A axis is represented by the dashed line A in FIG. 9 which represents a vertical 0° angle. In FIG. 8, the nozzle tube 106 is in line with the A axis and thus provides 0° tilt. In accordance with the invention, the motor 84 is selectively operated to turn the pinion 86 which selectively moves the curved rack 98 which tilts the tilt body 90 within the space 62. Particularly, the curved projections 80 are received in the curved grooves 94, as shown in FIGS. 6 and 7, to vary the tilt angle of the nozzle tube 106 relative to the A axis. This is done while maintaining focal point of the focusing tube 110 as illustrated in FIG. 9. This maintenance of the focal point is accomplished by use of the curved projections 80 and grooves 94, along with the curved rack 98.

The cutting system 10 includes a computerized numerical control (CNC) 130, see FIG. 1, for controlling the cutting operation. Particularly, the CNC 130 controls X, Y and Z positions of the cutting head assembly 12 in a conventional manner. Moreover, the CNC 130 combines control of the tilt angle and C axis rotation to control taper for both straight line cuts and arc cuts.

More particularly, the taper head control assembly 28 controls and directs a jet of water from the focusing tube 110 to reduce the taper effect which is inherent to water jet cutting. The taper head control assembly 28 tilts the jet up to 6° using the rack 98 and pinion 86 system driven by the brushless motor 84. The entire water jet assembly 30 including the on/off valve 102, nozzle tube 106, mixing chamber 108 and focusing tube 110 are tilted by the motorized tilt head control assembly 56 and guided by two curved linear guides 94. This maintains the focal point of the jet without the need of a Z-axis compensation routine.

The motorized tilt head control assembly 56 is mounted inside the C axis housing 34 as shown in FIG. 3. The collar 42, and in turn the tilt head control assembly 56, is driven by the brushless motor 54 through the timing belt 50 to also rotate the entire water jet assembly 30. Thus, the direction of the jet is a compound angle result created by the tilt of the A axis, up to 6°, and the rotation of the C axis through 360°. Determination of the compound angle control methodology is determined by the CNC 130 in a desired manner.

Figure 10:
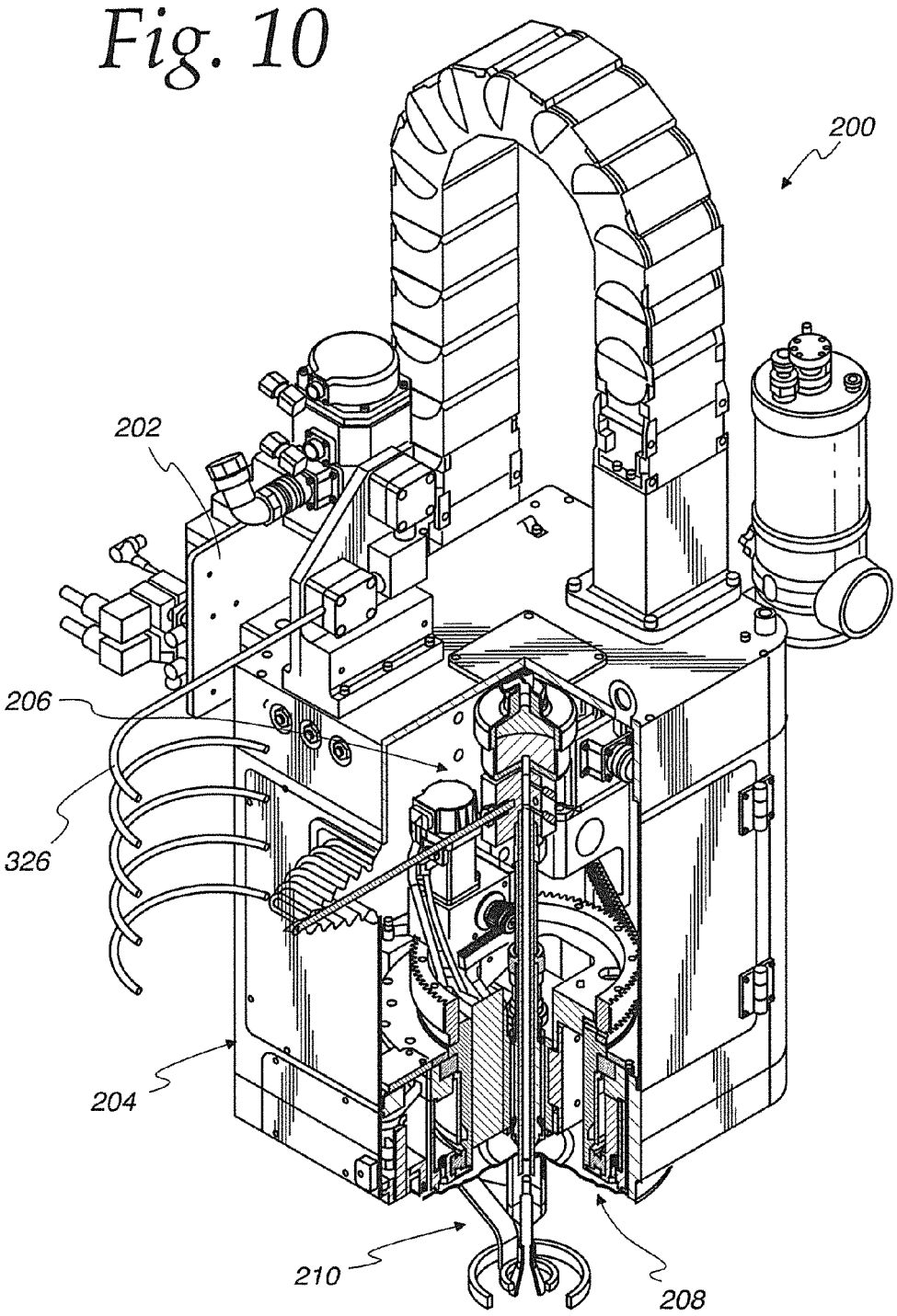
FIG. 10 is a perspective, partially section, view of a cutting head assembly for another embodiment.

FIG. 10 illustrates a cutting head assembly 200 according to an alternative embodiment. The cutting head assembly 200 differs from the cutting assembly 12, in part, in that tilt movement is mechanically implemented using a bearing system that rolls against a single curved surface rather than moving two curved surfaces against one another as with the embodiment discussed above.

The cutting assembly 200 includes a base 202 movably mountable in any known manner to the bridge 20, as with the embodiment discussed above. A parallelepiped housing 204 is fixedly mounted to the base 202 and is thus movable therewith. The housing 204 defines an enclosed space 206 housing a taper head control assembly 208 in accordance with the invention. The taper head control assembly 208 includes a cutting apparatus in the form of a water jet assembly 210, as described below, while maintaining a fixed focal point relative to the base 202. Thus, X, Y and Z axes movement of the water jet assembly 210 are controlled by a position of the base 202 and thus the housing 204, while A axis tilt and rotation about a C axis are controlled by the taper head control assembly 208, as described below.

Figure 11:
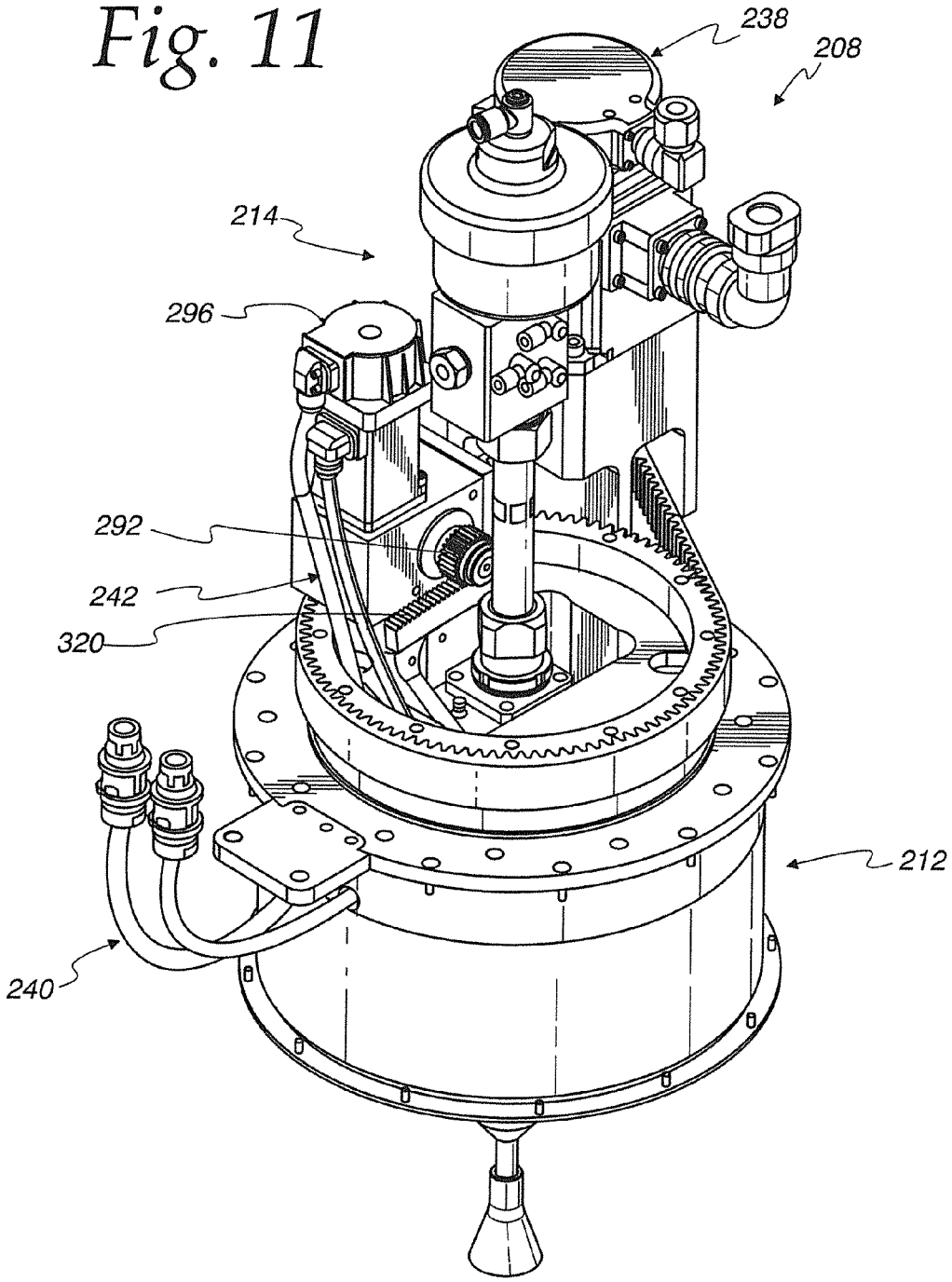
FIG. 11 is a perspective view of a taper head control assembly of the cutting head assembly of FIG. 10.

With reference to FIG. 11, the taper head control assembly 208 includes a C axis control assembly 212 for controlling rotational C axis movement in conjunction with a tilt head control assembly 214 for controlling a tilt angle relative to a vertical A axis.

Figure 12:
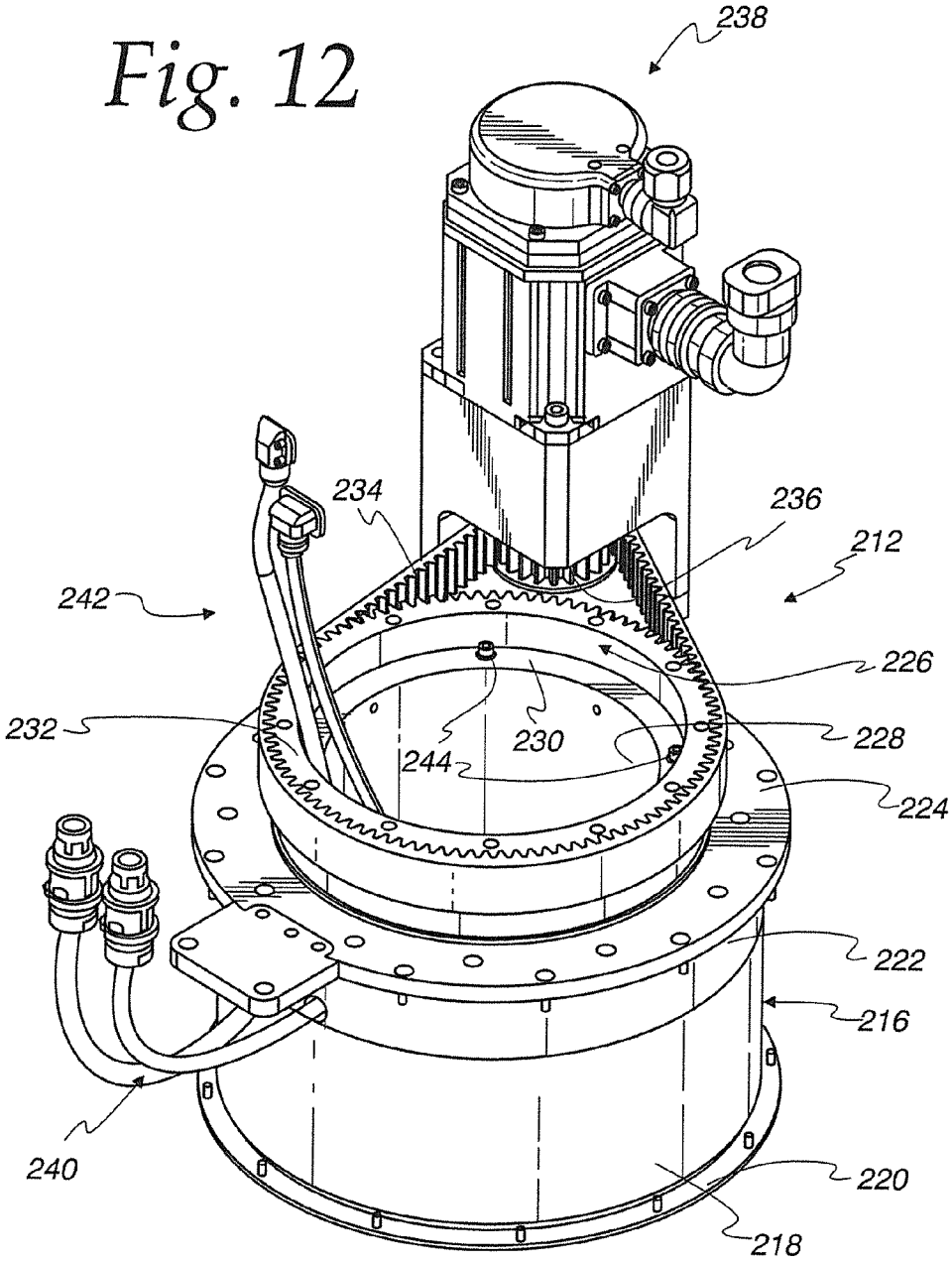
FIG. 12 is a perspective view of the C axis control assembly of the taper head control assembly of FIG. 11.

The C axis control assembly 212, see also FIG. 12, includes a generally cylindrical housing 216. The housing 216 is also referred to herein as a C axis housing or a rotational axis housing. The C axis housing 216 is fixedly mounted in the enclosure 204 in any known manner, as generally illustrated in FIG. 10. The C axis housing 216 comprises a lower cylindrical wall 218 having an outwardly turned flange 220 for mounting to the enclosure 204. An upper cylindrical wall 222 is atop the lower cylindrical wall 218. An upper annular flange 224 is atop the upper cylindrical wall 222.

A collar 226 is rotationally mounted in the C axis housing 216 and includes a cylindrical shell 228 having an upper annular edge 230. Suitable roller bearing structure, such as that disclosed above relative to FIG. 4A, is provided internally of the C axis housing 216 to facilitate rotation of the cylindrical shell 228.

A driven gear 232 is secured atop the cylindrical shell 228 and is driven by a timing belt 234 by a drive gear 236. The drive gear 236 is driven by a brushless motor 238. Particularly, the brushless motor 238 can be driven in either direction to selectively rotate the collar 228 relative to the C axis housing 216. The C axis control assembly 212 uses internal brushes and slip rings (not shown), as with the embodiment discussed above. A first set of electrical cords 240 is provided for electrical connection to the brushes with a second set of electrical cords 242 connecting slip rings to the tilt head control assembly 214. The shell upper annular edge 230 includes a plurality of threaded bosses 244 for securing the tilt head control assembly 214, as discussed below.

Figure 13:
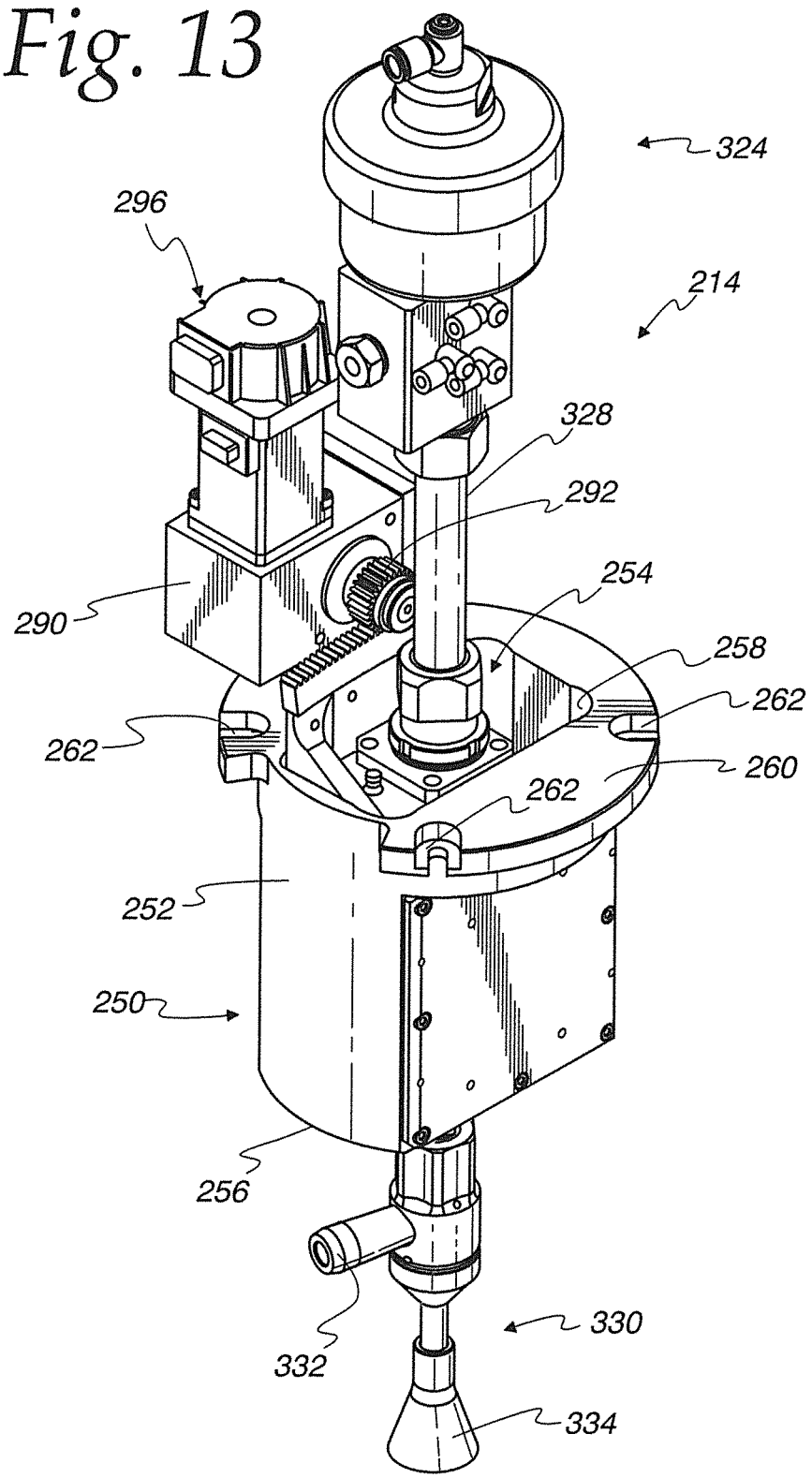
FIG. 13 is a perspective view of the tilt head control assembly of the taper head control assembly of FIG. 11.
Figure 14:
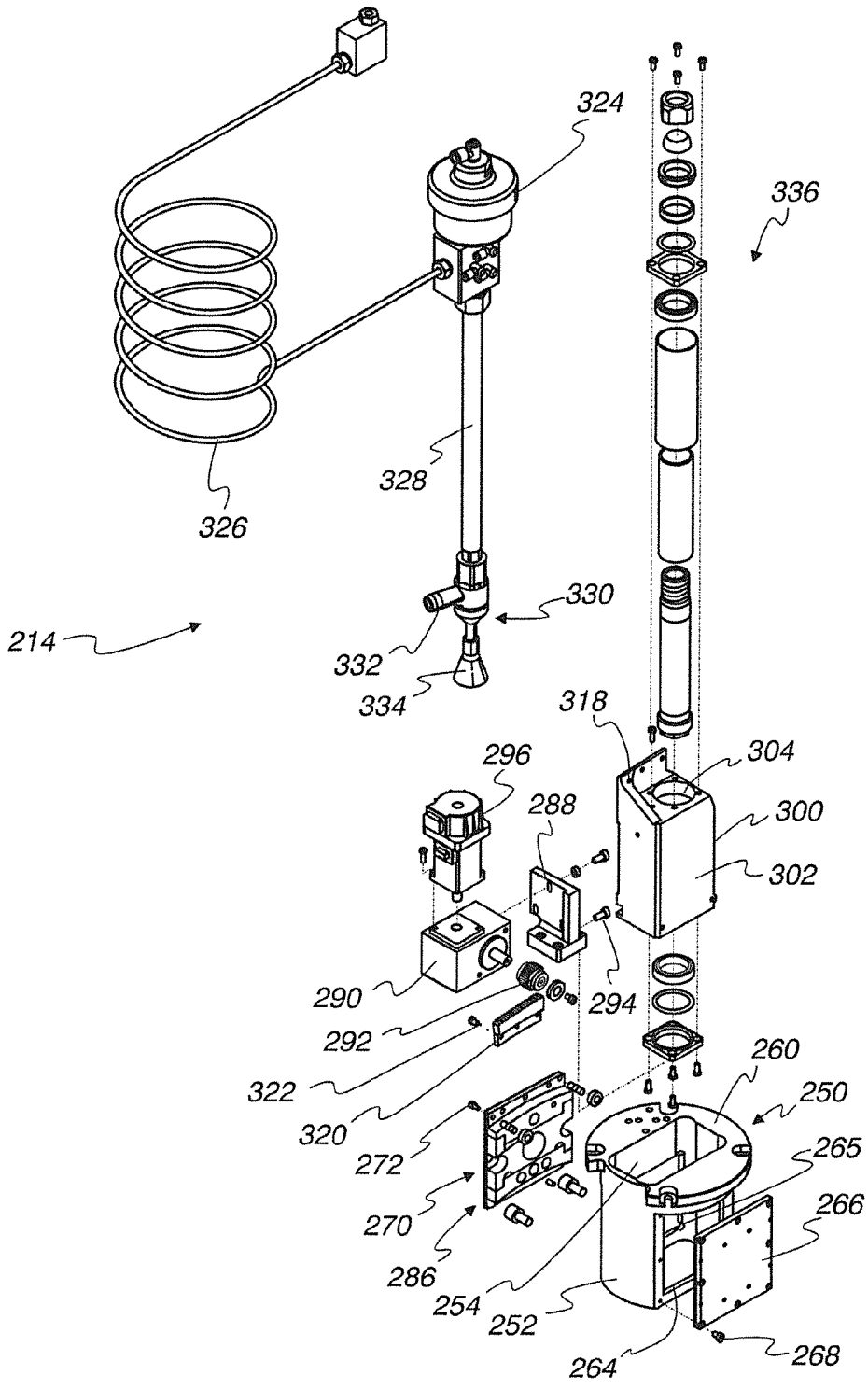
FIG. 14 is an exploded view of the tilt head control assembly of FIG. 13.

Referring to FIGS. 13 and 14, the motorized A axis tilt head control assembly 214 is illustrated. The tilt head control assembly 214 comprises a tilt housing 250. The tilt housing 250 comprises a generally tubular frame 252 defining an elongate interior space 254. The frame 252 is open at a bottom end 256 and an opposite top end 258. An annular flange 260 extends outwardly from the frame 252 at the top end 258. The annular flange 260 includes a plurality of slots 262 proximate its outer edge. The tilt housing 250 is of a size to be received in the C axis housing shell 228. The annular flange 260 of a size corresponding to the shell upper annular edge 230. The tilt housing 250 is secured to the shell 228, as generally illustrated in FIG. 11, via fasteners (not shown) through the slots 262 into the threaded bosses 244, see FIG. 12. As such, the tilt housing 250 is rotational with the collar 226 under control of the brushless motor 238.

Figure 19:
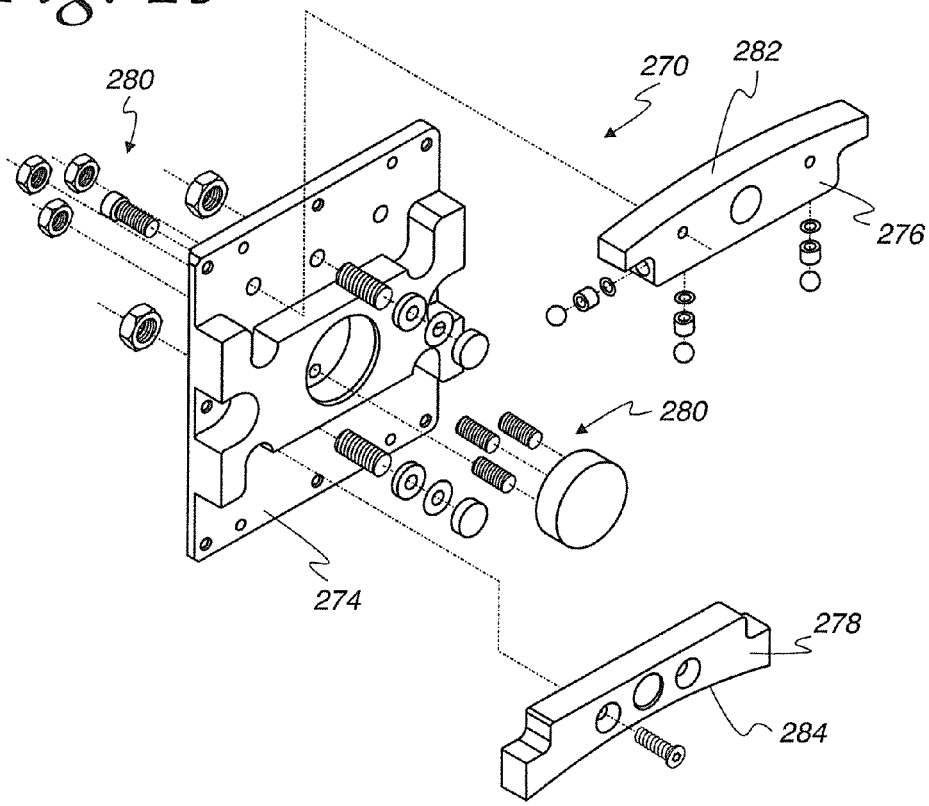
FIG. 19 is an exploded view of a slide of the tilt head control assembly of FIG. 13.

The tubular frame 252 includes a pair of rectangular front and rear side openings 264 and 265, respectively, see FIG. 14, on opposite sides thereof. A plate 266 is mounted over the front side opening 264, using fasteners 268. A slide 270 is mounted over the rear side opening 265 using fasteners 272. The slide 270, see FIG. 19, comprises a plate 274. An upper guide 276 and a lower guide 278 are secured by suitable fasteners 280 to the plate 274. The upper guide 276 includes a convex upper surface 282. The lower guide 278 includes a concave lower surface 284. The guides 276 and 278 define a curved projection 286, such as a curved rail, as with the embodiment above. Incident to the slide 270 being mounted to the tubular housing 252, the curved projection 286 extends into the housing space 254.

A bracket 288 is mounted atop a rear side of the annular flange 260. A gear box 290 having an output pinion 292 is secured to the bracket 288 using fasteners 294. A brushless motor 296 mounted to the gear box 290 drives the gears that are in the gear box 290 to in turn drive the pinion 292. The brushless motor 296 is electrically connected to the second set of electrical cords 242, see FIG. 11.

Figure 18:
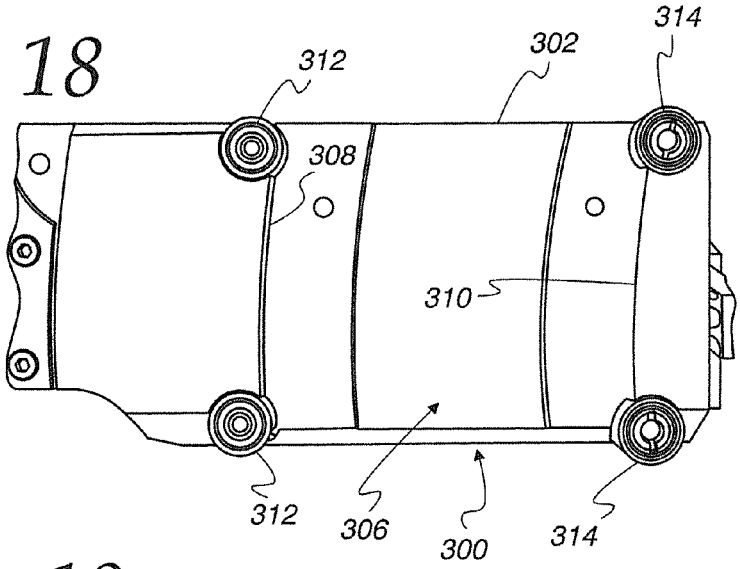
FIG. 18 is a rear elevation view of the tilt body of the tilt head control assembly of FIG. 13.

A tilt body 300 comprises an elongate block 302 having a cylindrical through opening 304. A curved or arcuate groove 306, see FIG. 18, is provided in a rear side of the block 302. The groove 306 is defined by an upper concave surface 308 and an opposite lower convex surface 310. Roller bearing 312 are provided at opposite ends of the concave surface 308. Opposite roller bearings 314 are provided at opposite ends of the convex surface 310. The groove 306 is of a size to receive the slide curved projection 286 with the roller bearings 312 and 314 riding on the curved surfaces 282 and 284, respectively.

In accordance with the invention, the tilt body block 302 is telescopically received in the tilt housing interior space 254 with the curved projection 286 received in the curved groove 306. As such the tilt body 300 can move laterally within the space 254 so that the tilt body 300 is effectively "tilted" relative to the tilt housing 250, as described below, owing to the curvature of the projection 286 and the groove 306.

The tilt body block 302 includes a rear projection 318 extending upwardly from a top end to support a curved rack 320 secured by fasteners 322. Incident to the tilt body 300 being positioned in the tilt housing space 254, the pinion 292 engages the rack 320 as shown in FIG. 11. Rotation of the pinion 292 moves the tilt body 300 laterally with the curvature of the projection 286 and groove 306 causing the tilt body 300 to tilt, as discussed above. As such, the motor 296 is operated to control a tilt angle of the tilt body 300 relative to the tilt housing 250.

The water jet assembly 210 comprises an on/off valve 324 for connection to a high pressure supply line 326. The valve 324 is connected to a nozzle tube 328 which is in turn connected to a mixing chamber 330 having a port 332 for connection to a supply of abrasive material. A focusing tube, similar to the focusing tube 110, discussed above, defining a nozzle, as connected to an outlet of the mixing chamber 330 and is surrounded by a splashguard 334.

The nozzle tube 328 is received in the tilt body cylindrical opening 304 using connecting structure, illustrated generally at 336, similar to that discussed above relative to FIG. 6.

Figure 15:
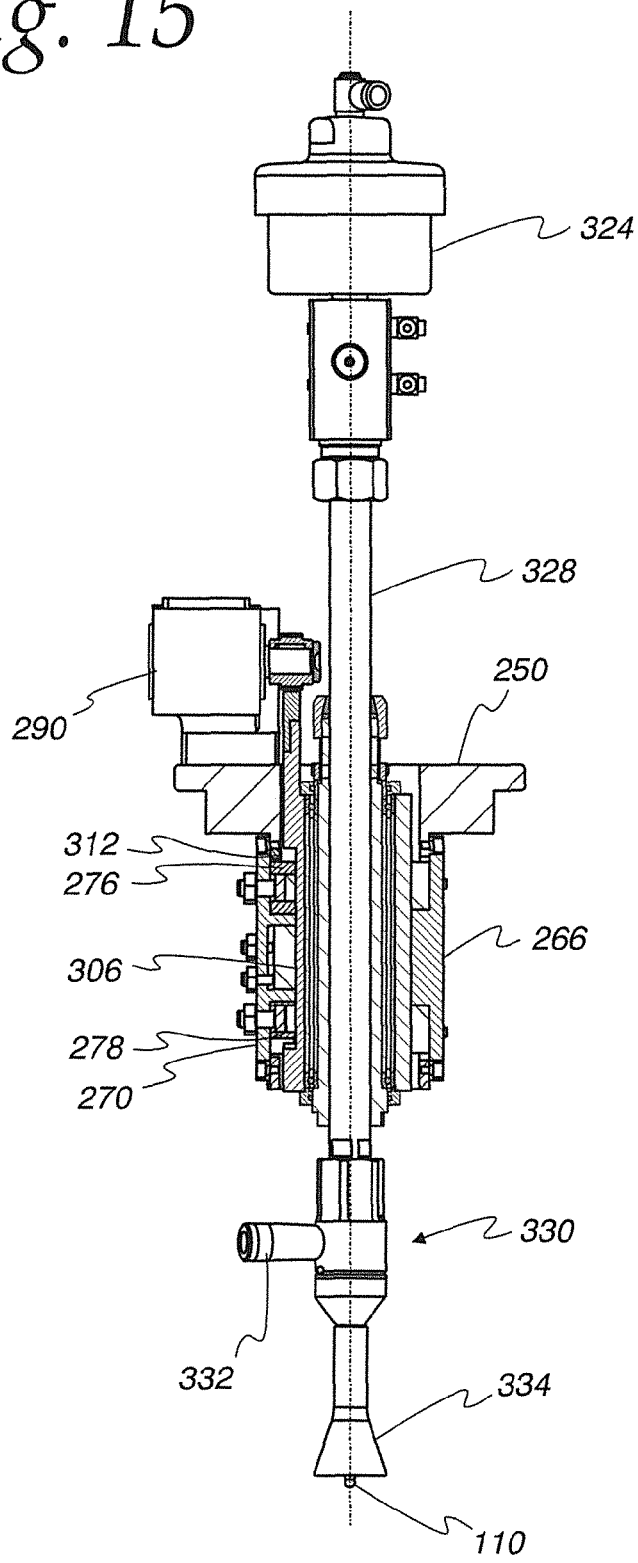
FIG. 15 is a side elevation, partially sectional, view of the tilt head control assembly of FIG. 13.
Figure 16:
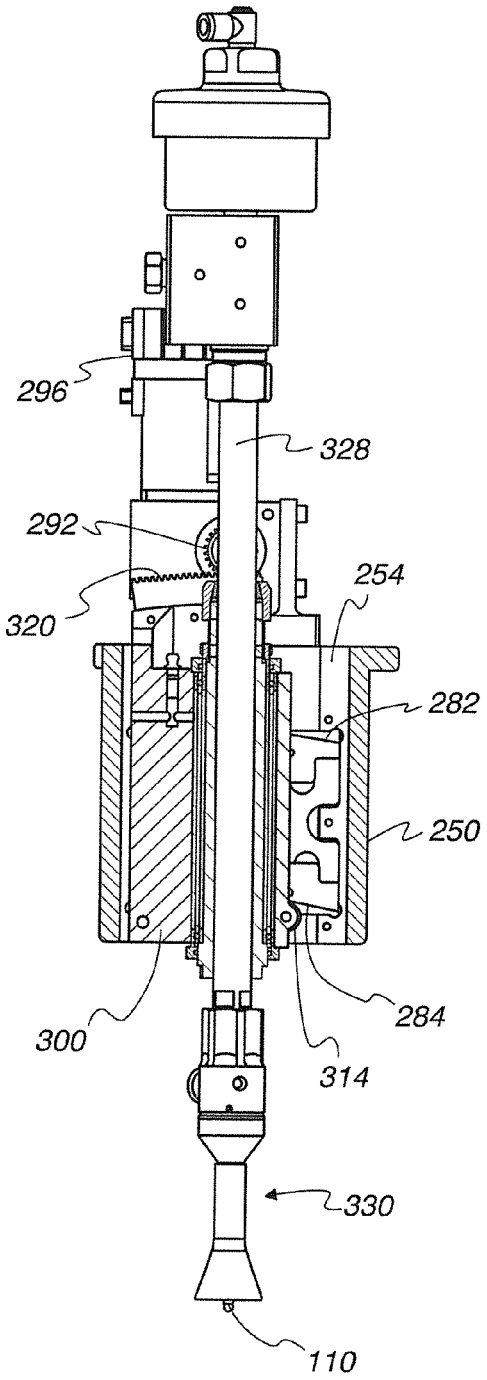
FIG. 16 is a front elevation, partially sectional, view of the tilt head control assembly of FIG. 13 with the nozzle at a 0° tilt angle.
Figure 17:
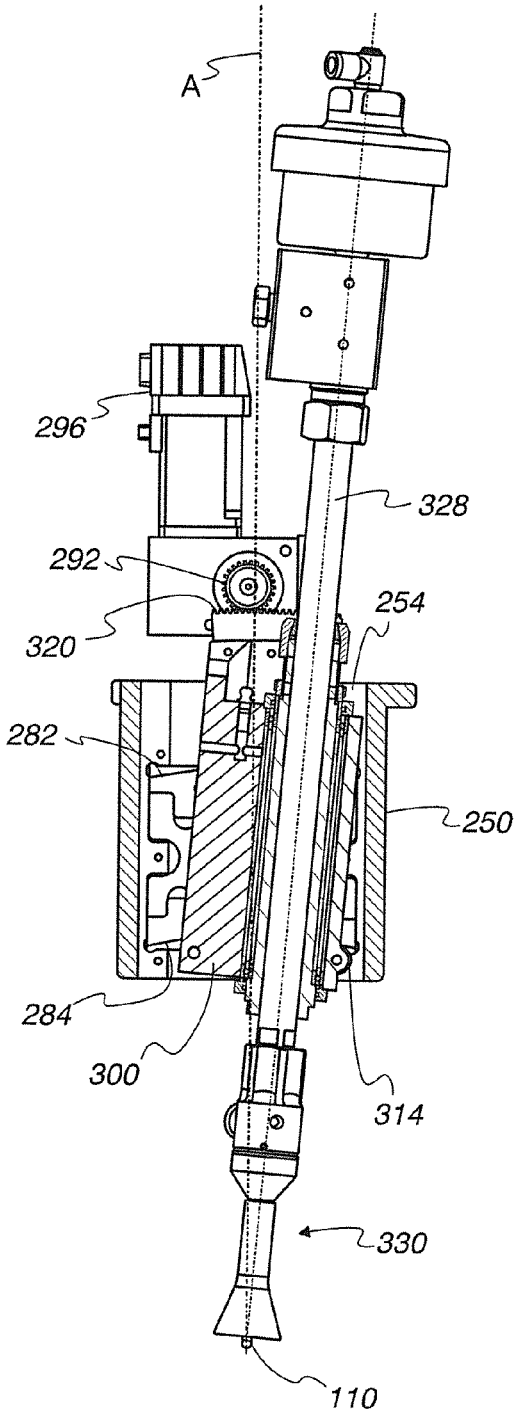
FIG. 17 is a front elevation, partially sectional, view, similar to FIG. 16, of the tilt head control assembly of FIG. 13 with the nozzle at a 6° tilt angle.

Referring to FIGS. 16 and 17, the A axis is represented by the dashed line A in FIG. 17 which represents a vertical 0° angle. In FIG. 16, the nozzle tube 328 is in line with the A axis and thus provides 0° tilt. In accordance with the invention, the motor 296 is selectively operated to turn the pinion 292 which selectively moves the curved rack 320 which tilts the tilt body 300 within the space 254. Particularly, the curved projection defined by the curved guides 276 and 278 are received in the curved groove 306, as generally illustrated in FIG. 15, to vary the tilt angle of the nozzle tube 328 relative to the A axis. This is done while maintaining focal point of the focusing tube 110. This maintenance of the focal point is accomplished by use of the curved projection 286 and the curved groove 306 along with the curved rack 320.

The particular control of compound movement is generally as discussed above relative to FIG. 1.

Figure 20:
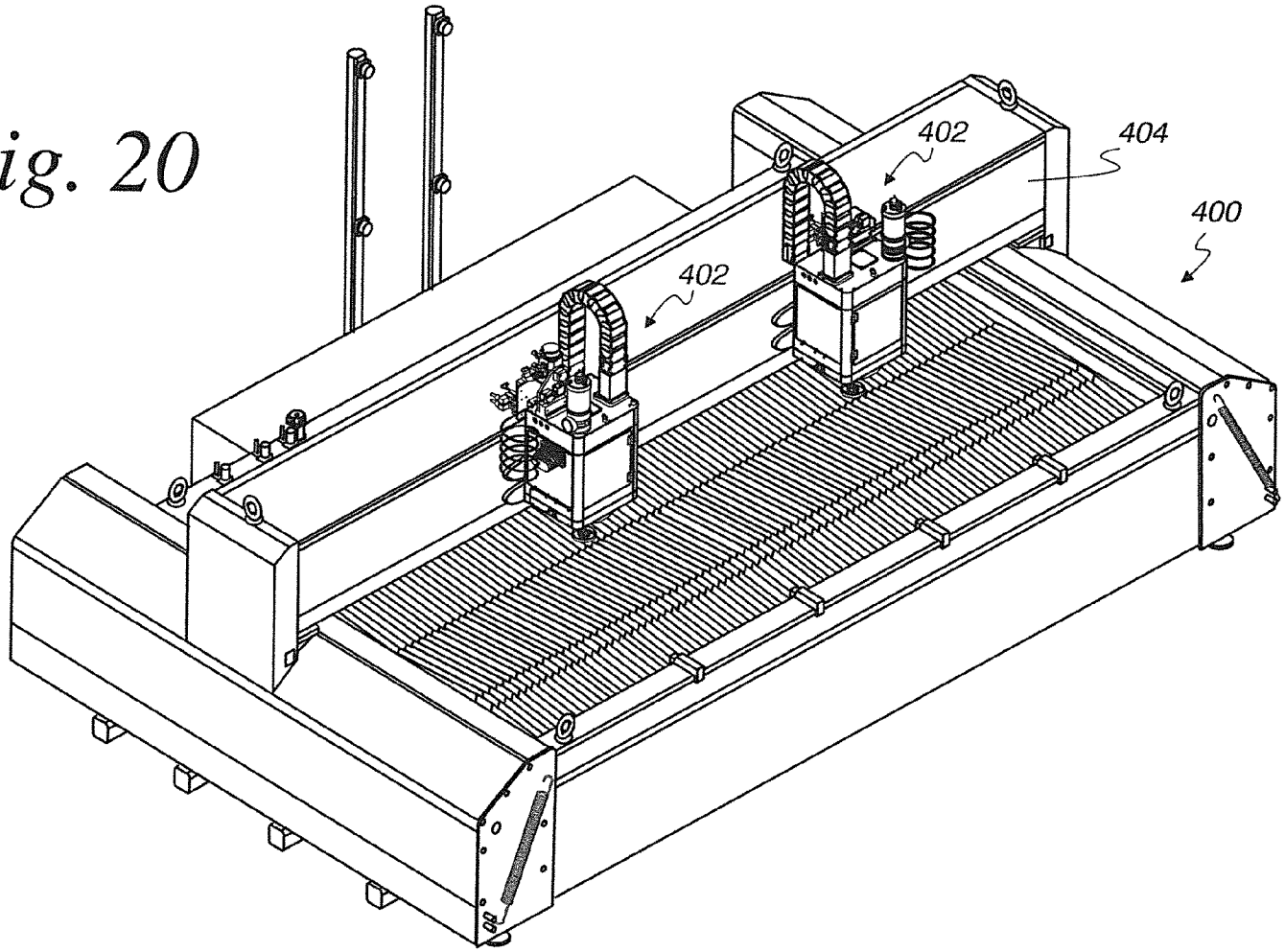
FIG. 20 is a perspective view of a high pressure water jet cutting system including dual cutting head assemblies.
Figure 21:
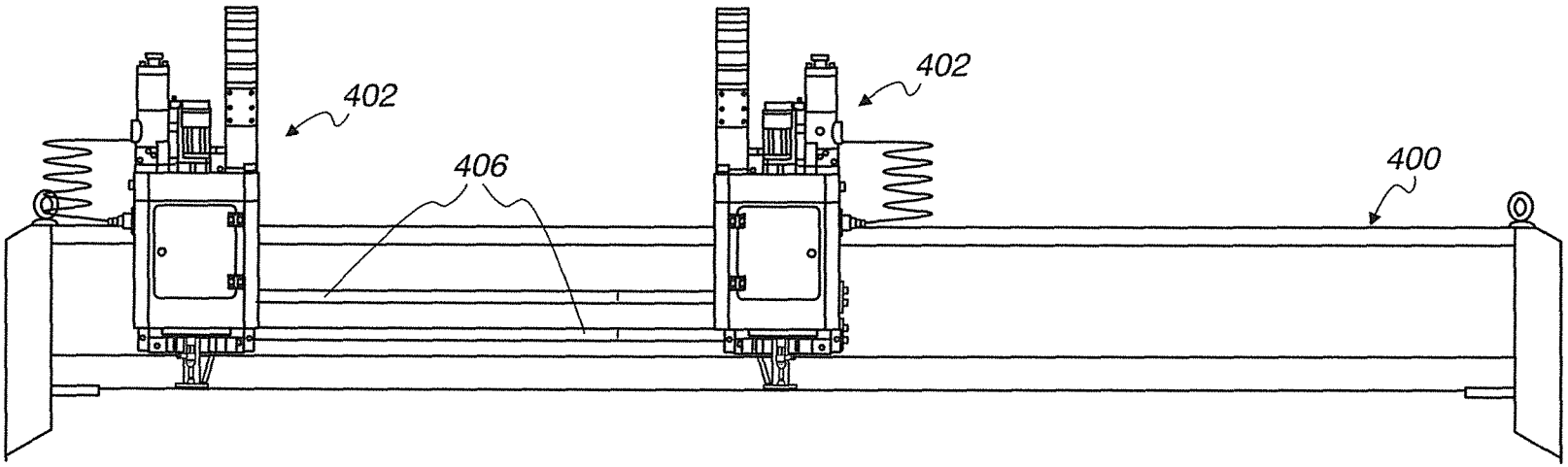
FIG. 21 is a schematic diagram illustrating interconnection between the dual cutting head assemblies of FIG. 20.

Referring to FIG. 20, a water jet cutting system 400 includes dual cutting head assemblies 402 mounted to a bridge 404. Each of the cutting assemblies 402 may be as discussed above. The cutting head assemblies 402 can be controlled independently or may be fixedly spaced relative to one another using linear bars 406. This can be used to operate the cutting head assemblies 402 in unison to cut multiple pieces simultaneously using a single program, as necessary or desired.

As will be apparent, the tilt head control assembly can be used with other forms of cutting apparatus where tilt angle control is required.

Thus, as described herein, there is provided a cutting head assembly for a cutting system and, more particularly, a taper head control assembly for a high pressure fluid jet cutting system.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A cutting head assembly for a high pressure fluid jet cutting system comprising:

a base moveably mounted relative to a tank;

a nozzle operatively connected to a source of high pressure fluid;

a tilt body carrying the nozzle and including a rack;

a tilt housing supporting the tilt body and including a pinion engaging the rack for selectively tilting the nozzle; and a rotational axis housing mounted to the base and including a collar rotatably mounted relative to the rotational axis housing, the collar carrying the tilt housing to selectively rotate the nozzle relative to the base.

2. The cutting head assembly of claim 1 wherein the tilt body comprises a groove and the tilt housing comprises a guide and wherein the guide is slideably received in the groove to support the tilt body in the tilt housing.

3. The cutting head assembly of claim 2 wherein the guide comprises a curved projection and the groove comprises a curved groove.

4. The cutting head assembly of claim 1 further comprising a motor mounted to the tilt housing for driving the pinion.

5. The cutting head assembly of claim 1 wherein the tilt housing comprises a tubular frame telescopically receiving the tilt body and wherein the tubular frame includes a guide having a curved projection and the tilt body includes a curved groove receiving the curved projection.

6. The cutting head assembly of claim 5 wherein the tilt body includes rollers at ends of the groove and the rollers ride on the curved projection.

7. The cutting head assembly of claim 1 further comprising a motor fixedly mounted relative to the base and a belt driven by the motor and operatively received on the collar to selectively rotate the nozzle relative to the base.

8. The cutting head assembly of claim 1 wherein the tilt housing and the tilt body are adapted to maintain a fixed focal point of the nozzle at any tilt angle.

9. The cutting head assembly of claim 1 wherein the tilt housing and the tilt body are adapted to tilt the nozzle at angle between 0° and about 6°.

10. The cutting head assembly of claim 1 wherein the tilt body comprises an elongate block having a cylindrical through opening receiving a nozzle tube, one end of the nozzle tube supporting the nozzle and an opposite end connected to the source of high pressure fluid, and the rack is secured to an upper end of the elongate block.

11. The cutting head assembly of claim 1 wherein the rack comprises a curved rack.

12. A taper head control assembly for a cutting system comprising:

a base moveably mounted relative to a cutting table;

a cutting apparatus;

a tilt body carrying the cutting apparatus and including a rack;

a tilt housing supporting the tilt body and including a pinion engaging the rack for selectively tilting the cutting apparatus; and a rotational axis housing mounted to the base and including a collar rotatably mounted relative to the rotational axis housing, the collar carrying the tilt housing to selectively rotate the cutting apparatus relative to the base.

13. The taper head control assembly of claim 12 wherein the tilt body comprises a groove and the tilt housing comprises a guide and wherein the guide is slideably received in the groove to support the tilt body in the tilt housing.

14. The taper head control assembly of claim 13 wherein the guide comprises a curved projection and the groove comprises a curved groove.

15. The taper head control assembly of claim 12 further comprising a motor mounted to the tilt housing for driving the pinion.

16. The taper head control assembly of claim 12 wherein the tilt housing comprises a tubular frame telescopically receiving the tilt body and wherein the tubular frame includes a guide having a curved projection and the tilt body includes a curved groove receiving the curved projection.

17. The taper head control assembly of claim 16 wherein the tilt body includes rollers at ends of the groove and the rollers ride on the curved projection.

18. The taper head control assembly of claim 12 further comprising a motor fixedly mounted relative to the base and a belt driven by the motor and operatively received on the collar to selectively rotate the cutting apparatus relative to the base.

19. The taper head control assembly of claim 12 wherein the tilt housing and the tilt body are adapted to maintain a fixed focal point of the cutting apparatus at any tilt angle.

20. The taper head control assembly of claim 12 wherein the tilt housing and the tilt body are adapted to tilt the cutting apparatus at angle between 0° and about 6°.

21. The taper head control assembly of claim 12 wherein the tilt body comprises an elongate block having a cylindrical through opening receiving a nozzle tube, one end of the nozzle tube supporting a nozzle and an opposite end connected to a source of high pressure fluid, and the rack is secured to an upper end of the elongate block.

22. The taper head control assembly of claim 12 wherein the rack comprises a curved rack.

* * * * *